US006334621B1

(12) United States Patent
Chang

(10) Patent No.: US 6,334,621 B1
(45) Date of Patent: Jan. 1, 2002

(54) EASY-TO-INSTALL/DETACH SKATE BASE FOR A ROLLER SKATE

(76) Inventor: Chun-Cheng Chang, No. 492-16, Chia-Li Hsing, Chia-Li Town, Tainan Hsien (TW)

( * ) Notice: Subject to any disclaimer, the term of this patent is extended or adjusted under 35 U.S.C. 154(b) by 0 days.

(21) Appl. No.: 09/598,301

(22) Filed: Jun. 21, 2000

(30) Foreign Application Priority Data

May 2, 2000 (TW) ..... 89207310 U
May 9, 2000 (TW) ..... 89207887 U

(51) Int. Cl.[7] ..... A63C 1/02; A63C 17/02
(52) U.S. Cl. ..... 280/11.3; 280/11.221
(58) Field of Search ..... 280/7.12, 7.13, 280/11.3, 11.221, 11.231, 11.27; 36/15, 132

(56) References Cited

U.S. PATENT DOCUMENTS 2,998,260 A * 8/1961 Meyer ..... 280/7.13
4,666,168 A * 5/1987 Hamill et al. ..... 280/11.2
5,314,199 A * 5/1994 Olson et al. ..... 280/7.13
5,340,132 A * 8/1994 Malewicz ..... 280/11.22
5,507,506 A * 4/1996 Shadroui ..... 280/11.22
5,662,338 A * 9/1997 Steinhauser, Jr. ..... 280/7.14
6,116,620 A * 9/2000 Gabrielli ..... 280/11.19
6,120,038 A * 9/2000 Dong et al. ..... 280/7.13
6,164,669 A * 12/2000 Svensson ..... 280/11.3
6,270,089 * 8/2001 Marechal ..... 280/11.3

* cited by examiner

*Primary Examiner*—Brian L. Johnson
*Assistant Examiner*—Gerald Klebe
(74) *Attorney, Agent, or Firm*—Bacon & Thomas, PLLC

(57) ABSTRACT

A skate base for a roller skate is attached to a shoe sole having at least two engaging sections on an underside thereof. The engaging portions are located corresponding to front and rear ends of an arch of a wearer's foot. The skate base has engaging members formed on a top thereof for releasably engaging with the engaging sections on the shoe sole. The skate base includes several axles to which wheels are rotatably mounted.

6 Claims, 10 Drawing Sheets

EASY-TO-INSTALL/DETACH SKATE BASE FOR A ROLLER SKATE

BACKGROUND OF THE INVENTION

1. Field of the Invention

The present invention relates to a skate base for a roller skate, and more particularly to a skate base that can be easily attached to or detached from an underside of a shoe sole.

2. Description of the Related Art

U.S. patent application Ser. No. 09/325,379 filed on Jun. 4, 1999 discloses a roller skate with two compartments in an underside of a base thereof and two wheel assemblies mounted in the compartments, respectively. Each wheel assembly includes a pivotal seat having a first end secured to the base of the roller skate, a wheel seat having a first end pivotally connected to a second end of the pivotal seat, and a wheel rotatably mounted to a second end of the wheel seat. The wheel of the wheel assembly is extended out of the associated compartment for skating when in use. The wheel assembly is in a folded status and received in an associated compartment when not skating. Nevertheless, the wheels are still attached to the shoes when not in use and thus burdens the user during walking. The intended comfort provided by resiliency of the shoe soles cannot be obtained.

SUMMARY OF THE INVENTION

It is the primary object of the present invention to provide a roller skate, wherein the skate base and the shoe have an engaging means provided therebetween. This allows easy detachment of the skate base from the shoe when not skating, thereby reducing the overall weight for the shoe.

It is the secondary object of the present invention to provide a roller skate, wherein the skate base and the shoe have an engaging means provided therebetween. This allows easy detachment of the skate base from the shoe when not skating, thereby providing comfort wearing of the shoe by resiliency provided by the shoe sole.

In accordance with an aspect of the invention, a skate base for a roller skate is attached to a shoe sole having at least two engaging sections on an underside thereof. The engaging portions are located corresponding to front and rear ends of an arch of a foot. The skate base has engaging members formed on a top thereof for releasably engaging with the engaging sections on the shoe sole. The skate base includes several axles to which wheels are rotatably mounted.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Figure 1:
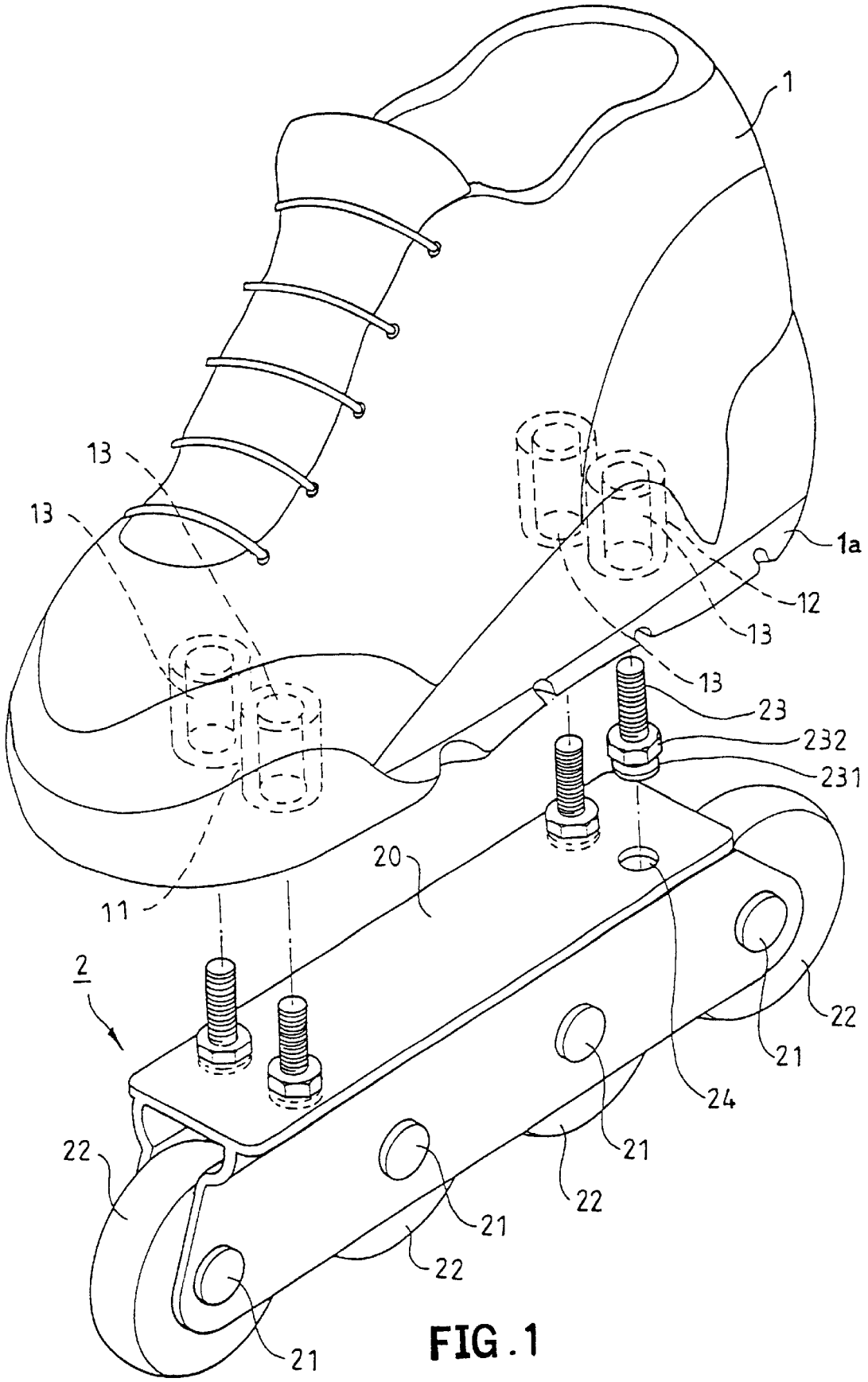
FIG. 1 is an exploded perspective view of a first embodiment of a roller skate in accordance with the present invention.

Referring to FIG. 1, a first embodiment of a roller skate in accordance with the present invention generally includes a shoe I (one of a pair of shoes) and a skate base 2. The shoe 1 includes at least two engaging sections 11 and 12 in an underside of a sole la thereof The engaging sections 11 and 12 are preferably located corresponding to front and rear ends of an arch of a wearer's foot. In this embodiment, each of two engaging sections 11 and 12 has two inserts 13 embedded in the sole la, each insert 13 having a screw hole (not labeled).

The skate base 2 includes a top side 20 for engaging with the shoe sole la. The skate base 2 further includes a plurality of axles 21 each for rotatably mounting a wheel 22. Engaging members 23 are provided on the top side 20 of the skate base 2. In this embodiment, the top side 20 includes two positioning holes 24 in each of front and rear ends thereof Each engaging member 23 is in the form of a bolt extended through an associated positioning hole 24. Each engaging member 23 further includes an enlarged lower end 231 that is located to an underside of the skate base 2 (FIG. 2) for preventing disengagement of the engaging member 23. In addition, each engaging member 23 includes a non-circular drive section 232 to facilitate rotation of the engaging member 23, thereby engaging the skate base 2 with the shoe 1 by the engaging member 23.

Figure 2:
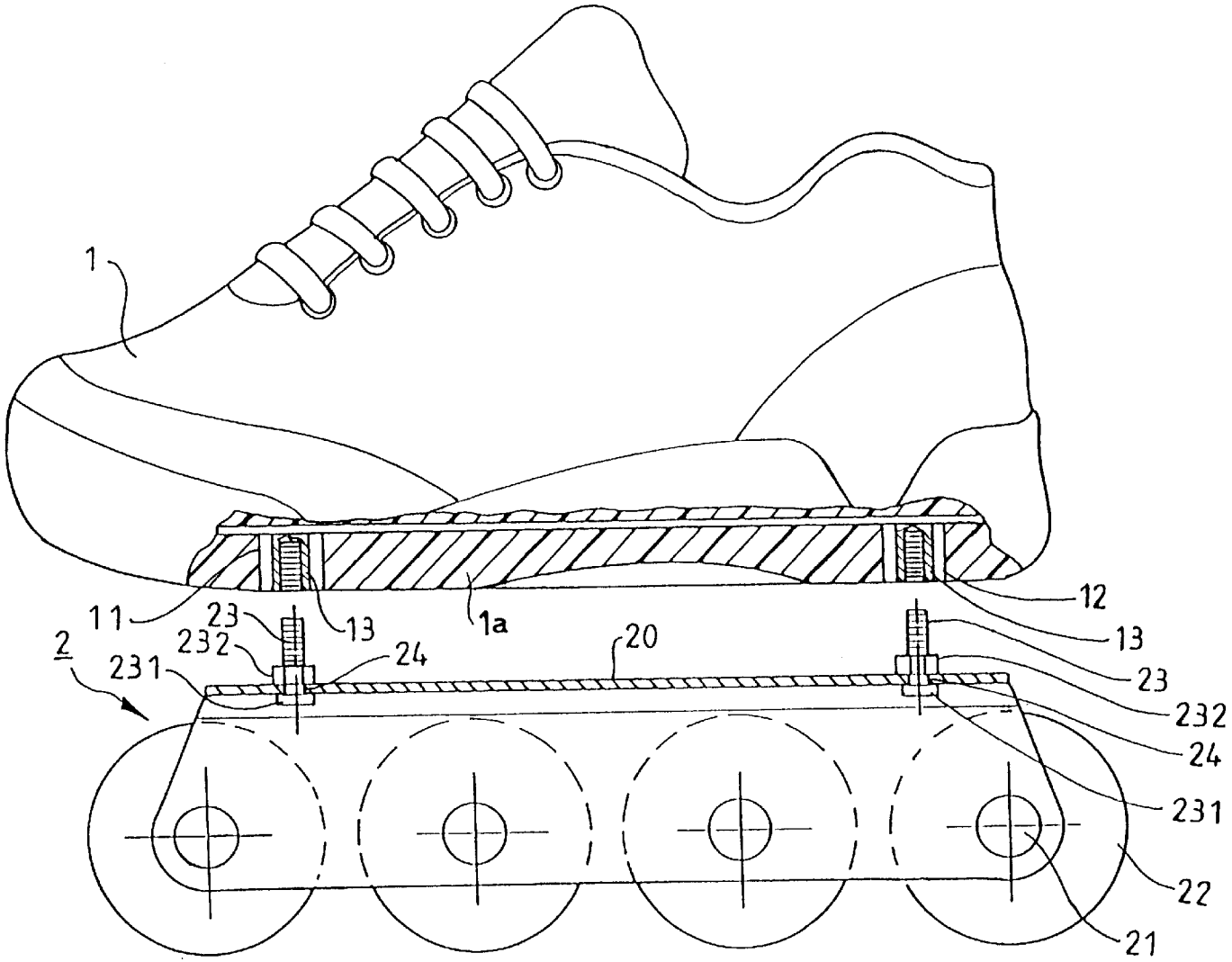
FIG. 2 is an exploded side view, partly sectioned, of the roller skate in FIG. 1.
Figure 3:
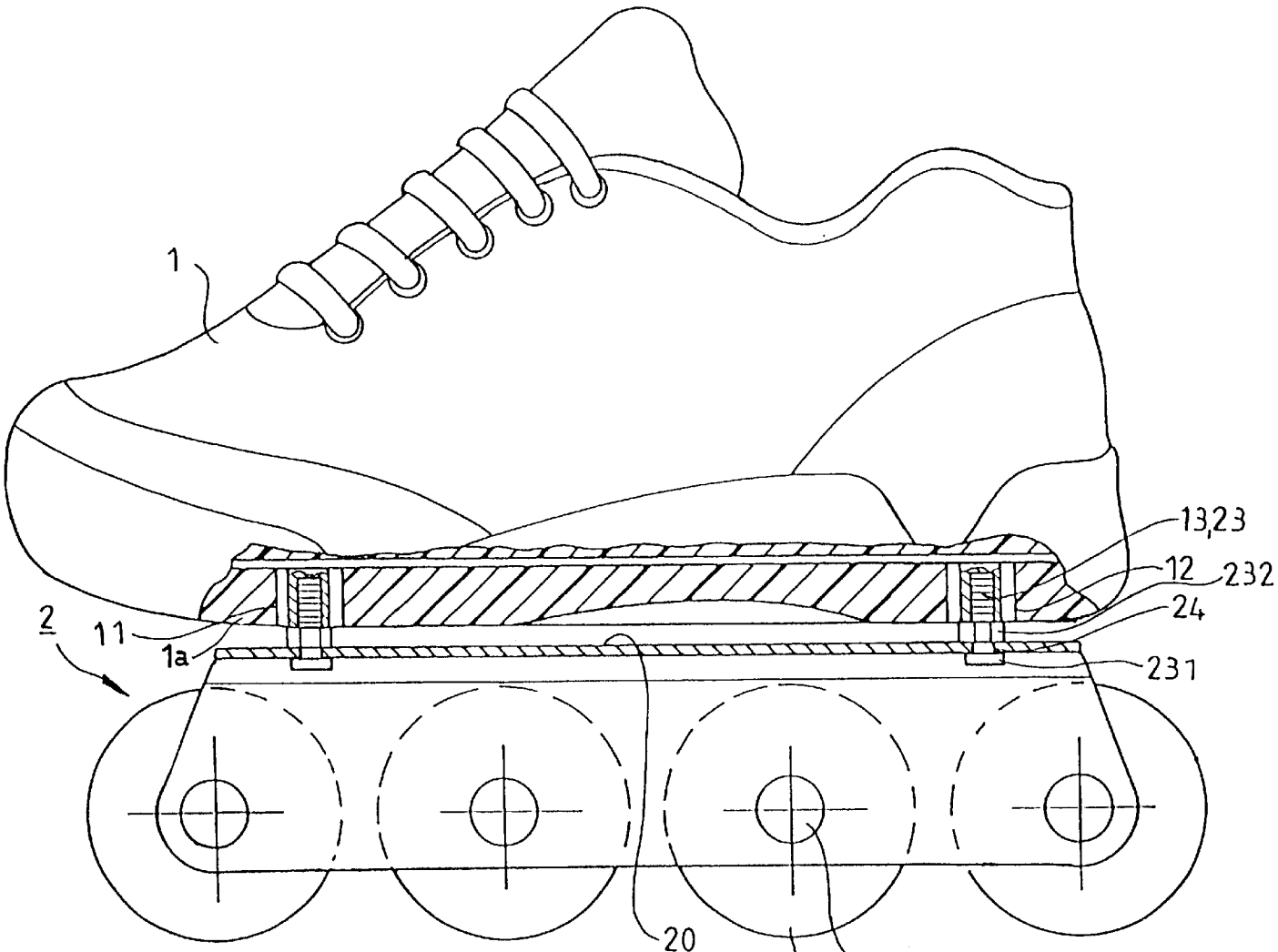
FIG. 3 is a side view, partly sectioned, of the roller skate in FIG. 1.

Referring to FIGS. 2 and 3, when the user intends to skate, the engaging members 23 on the skate base 2 are engaged with the screw holes of the inserts 13 in the shoe sole la to form a roller skate. When the user does not want to skate, the engaging members 23 allow easy detachment of the skate base 2 from the shoe sole la, thereby reducing the weight and providing comfort wearing.

Figure 4:
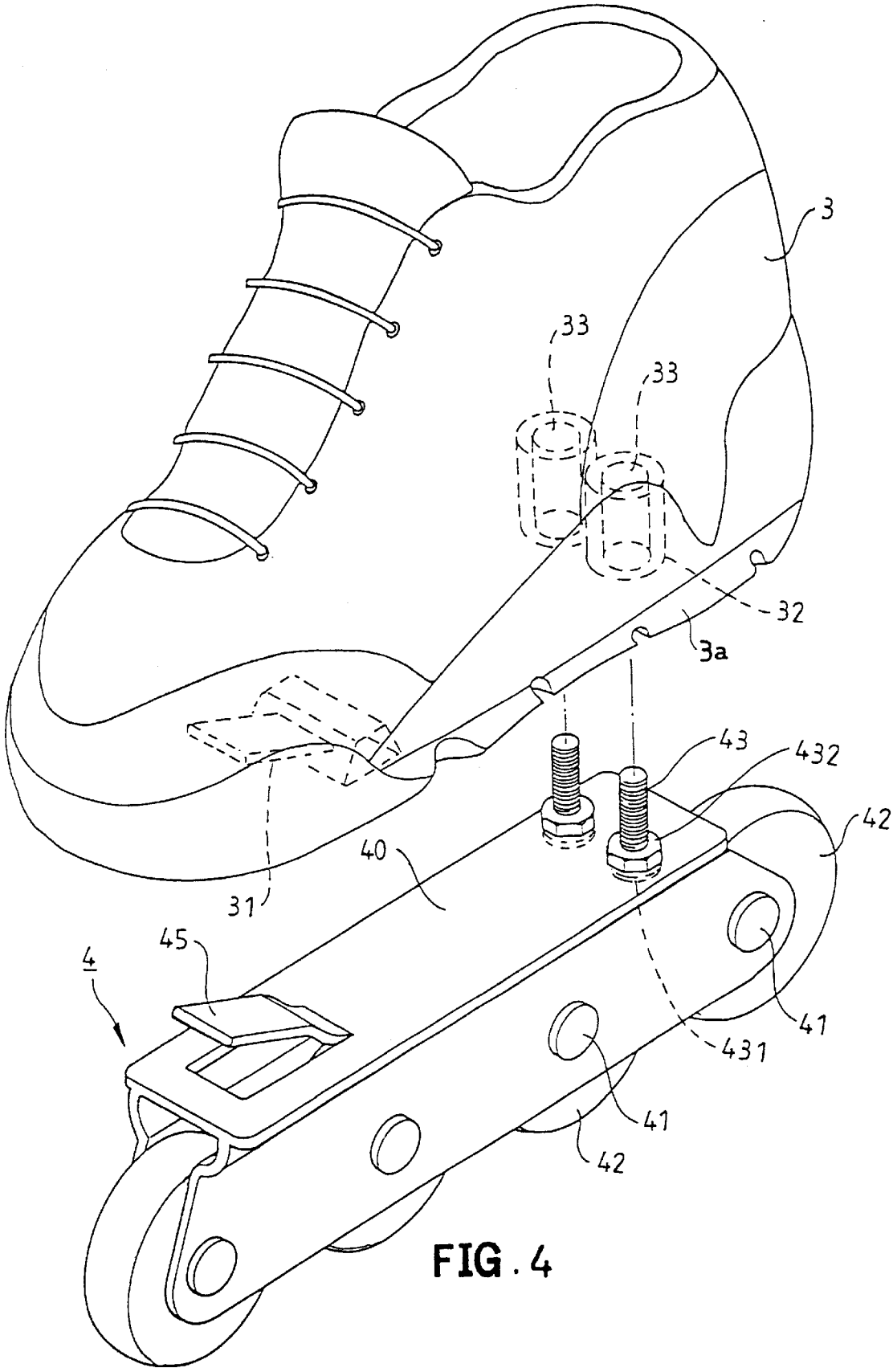
FIG. 4 is an exploded perspective view of a second embodiment of the roller skate in accordance with the present invention.

FIG. 4 illustrates a second embodiment of the roller skate in accordance with the present invention. The roller skate includes a shoe 3 and a skate base 4. The shoe 3 includes at least two engaging sections 31 and 32 in an underside of a sole 3*a* thereof The engaging sections 31 and 32 are preferably located corresponding to front and rear ends of an arch of a wearer's foot. In this embodiment, the rear engaging section 32 has two inserts 33 embedded in the sole 3*a*, each insert 33 having a screw hole (not labeled). The front engaging section 31 includes an engaging hole 33 or slot.

The skate base 4 includes a top side 40 for engaging with the shoe sole 3*a*. The skate base 4 further includes a plurality of axles 41 each for rotatably mounting a wheel 42. An engaging piece 45 is provided on a front end of the top side 40 of the skate base 4 for engaging with the engaging hole 31 of the shoe 3. Two engaging members 43 are provided on a rear end of the top side 40 of the skate base 4. The top side 40 includes two positioning holes 44 in the rear end thereof.

Each engaging member 43 is in the form of a bolt extended through an associated positioning hole 44. Each engaging member 43 further includes an enlarged lower end 431 that is located to an underside of the skate base 4 (FIG. 5) for preventing disengagement of the engaging member 43. In addition, each engaging member 43 includes a non-circular drive section 432 to facilitate rotation of the engaging member 43, thereby engaging the skate base 4 with the shoe 3 by the engaging member 43.

Figure 5:
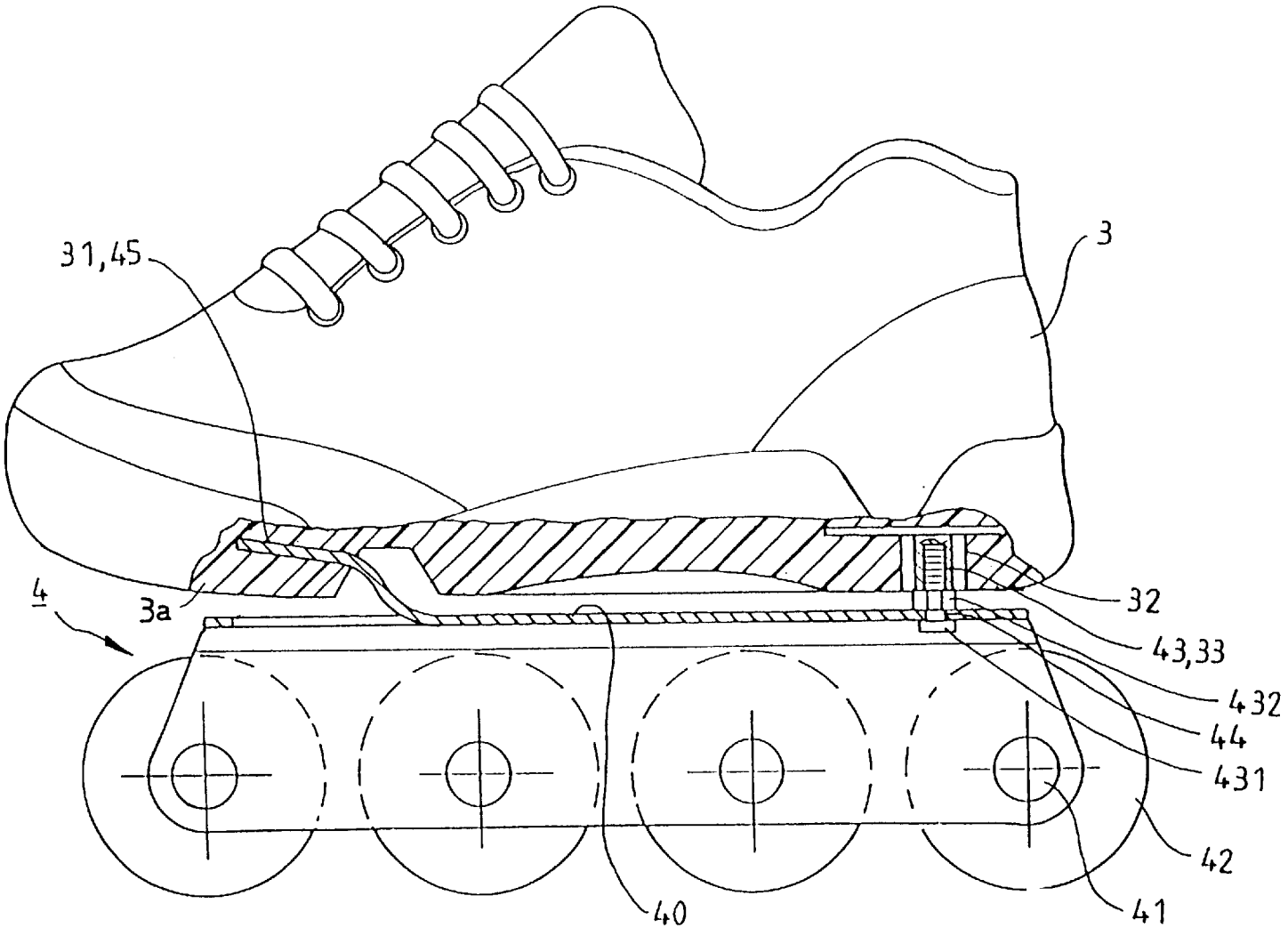
FIG. 5 is a side view, partly sectioned, of the roller skate in FIG. 4.

Referring to FIG. 5, when the user intends to skate, the engaging piece 45 of the skate is base 4 is engaged with the engaging hole 31 of the shoe 3 and the engaging members 43 on the skate base 4 are engaged with the screw holes of the inserts 33 in the shoe sole 3*a* to form a roller skate. When the user does not want to skate, the engaging members 43 allow easy detachment of the skate base 4 from the shoe sole 3*a*, thereby reducing the weight and providing comfort wearing.

Figure 6:
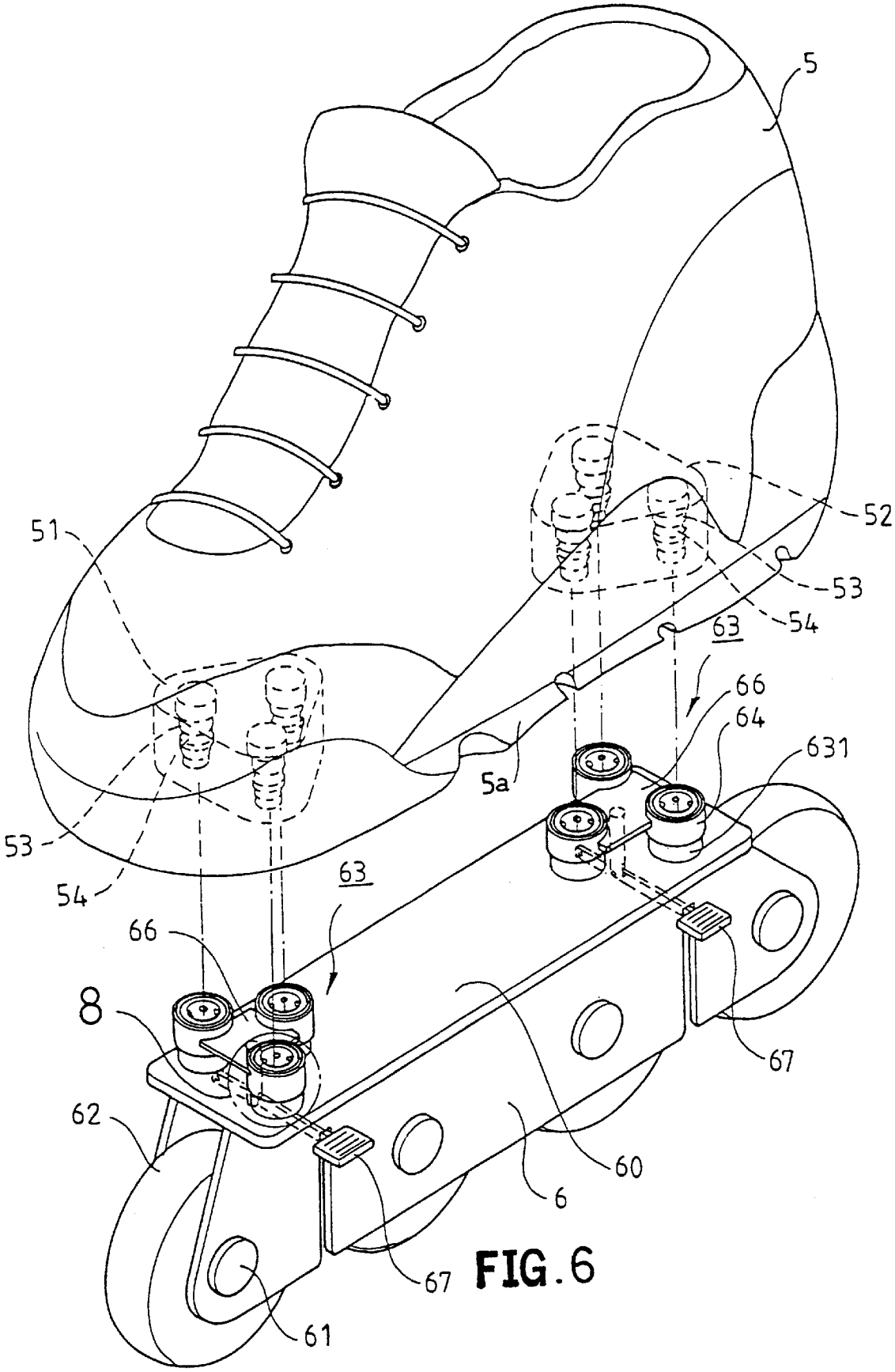
FIG. 6 is an exploded perspective view of a third embodiment of the roller skate in accordance with the present invention.
Figure 7:
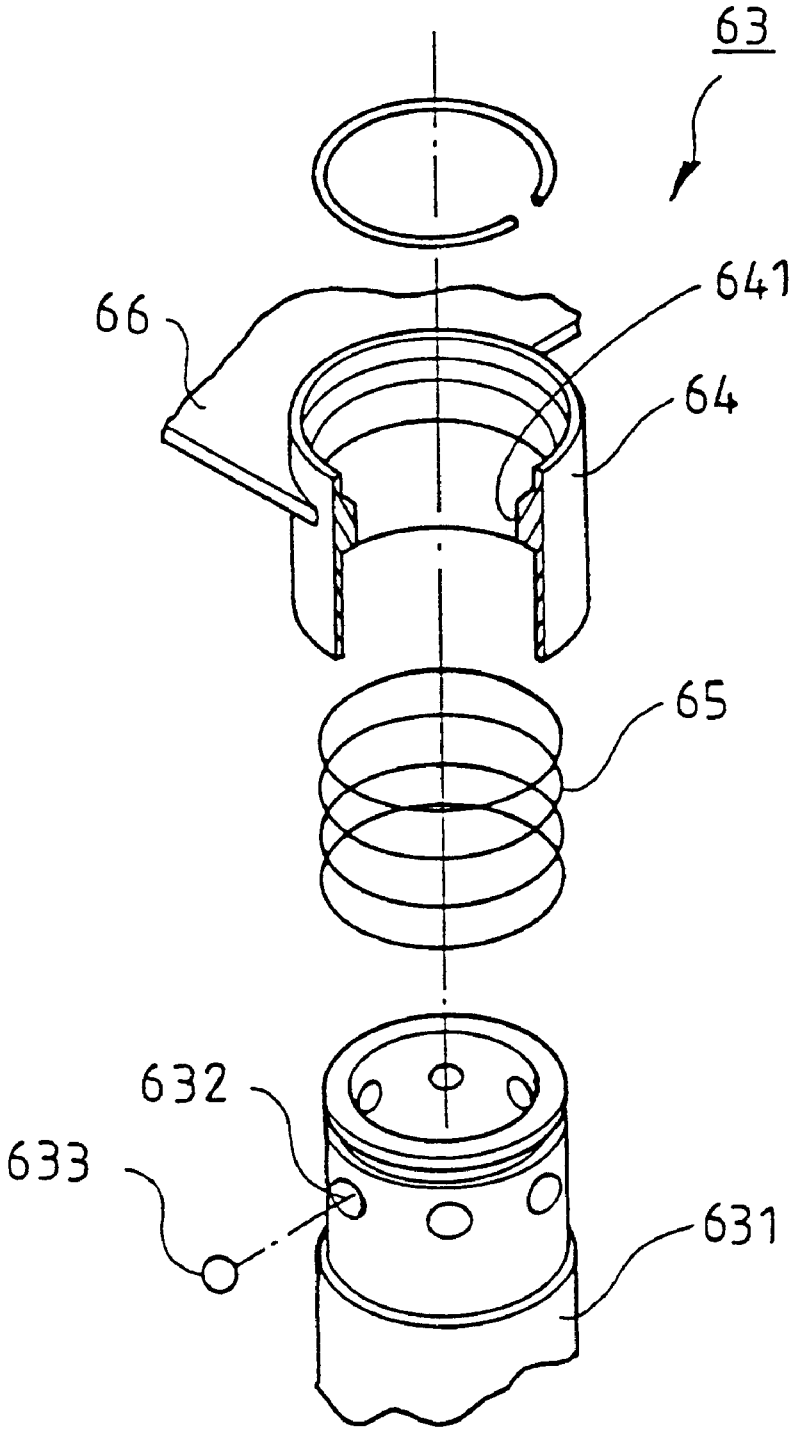
FIG. 7 is an exploded perspective view illustrating an engaging means used in the third embodiment of the roller skate in accordance with the present invention.
Figure 10:
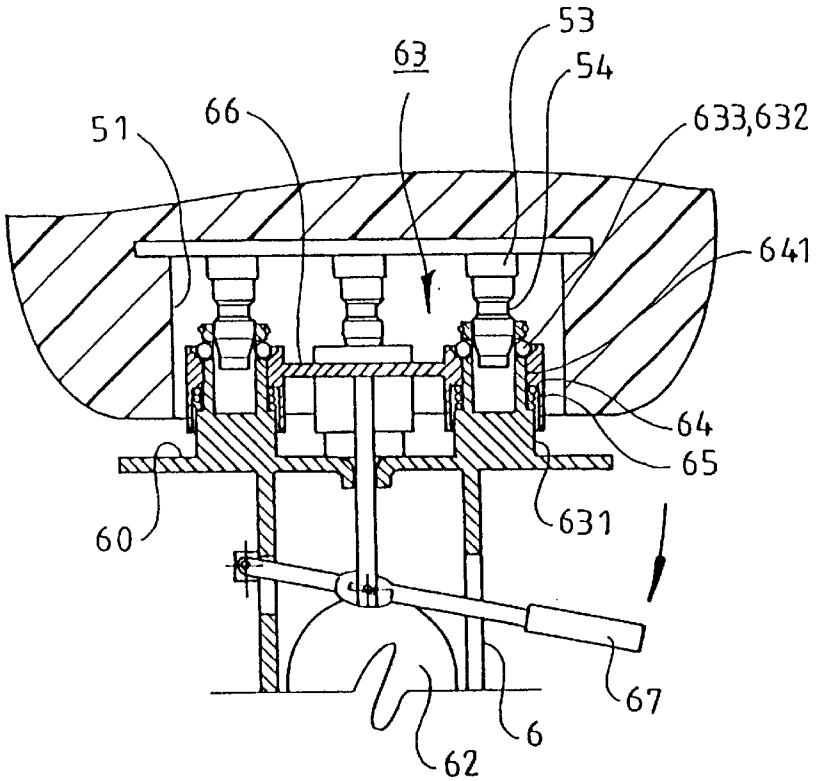
FIG. 10 is a sectional view similar to FIG. 9, illustrating disengaging of the skate base from the shoe.
Figure 9:
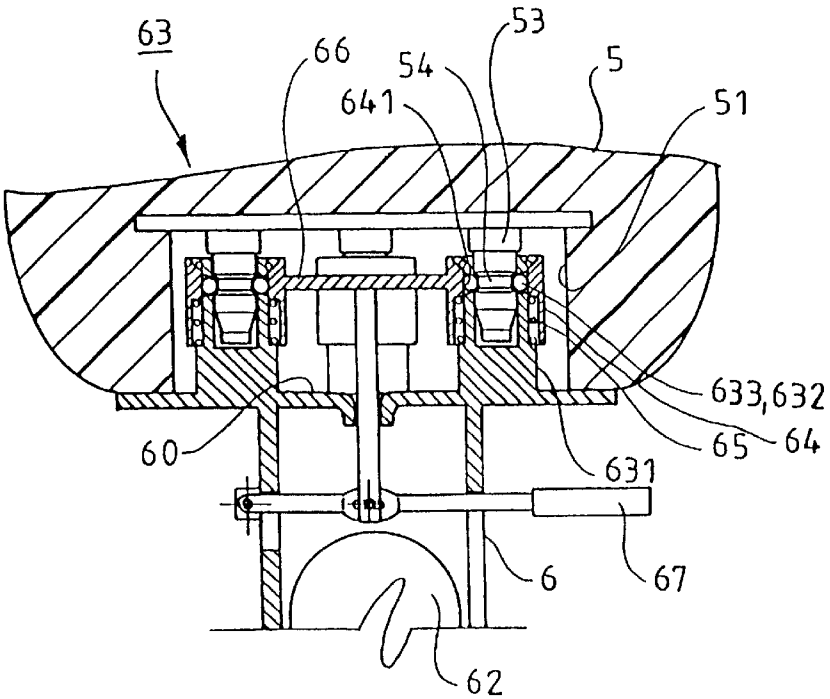
FIG. 9 is a sectional view taken along line 9—9 in FIG. 8.

FIG. 6 illustrates a third embodiment of the roller skate in accordance with the present invention. The roller skate includes a shoe 5 and a skate base 6. The shoe 5 includes at least two engaging sections 51 and 52 in an underside of a sole 5*a* thereof. The engaging sections 51 and 52 are preferably located corresponding to front and rear ends of an arch of a wearer's foot. In this embodiment, each of two engaging sections 51 and 52 has at least one rod 53 extended therefrom, each rod 53 including an annular groove 54 in an outer periphery thereof The skate base 6 includes a top side 60 for engaging with the shoe sole 5*a*. The skate base 6 further includes a plurality of axles 61 each for rotatably mounting a wheel 62. Engaging members 63 are provided on the top side 60 of the skate base 6. In this embodiment, the top side 60 includes three engaging members 63 in each of front and rear ends thereof. Referring to FIGS. 6 and 7, each engaging member 63 includes a tube 631 for receiving an associated rod 53. The tube 631 includes at least one radial conic hole 632 that converges inward. Each radial conic hole 632 includes a ball 633 that may partially protrude into an interior of the tube 632 without the risk of disengagement from the tube 632, thereby engaging with the annular groove 54 of the associated rod 53. A sleeve 64 is mounted around the tube 631 and slidable relative to the tube 631 along a longitudinal direction. The sleeve 64 includes an inner flange 641 for biasing the balls 632 inward so as to be engaged with the annular groove 54 of the associated rod 53 when required. As illustrated in FIGS. 6 and 7, when several engaging members 63 are provided, the sleeves 64 respectively around the tubes 631 are connected by a common plate 67, which is connected to and thus actuatable by a control plate 67. By such arrangement, the sleeves 64 are simultaneously moved downward by a single control plate 67 (FIGS. 9 and 10) such that the balls 633 of each engaging member 63 are disengaged from the annular groove 54 of the associated rod 53, thereby allowing disengagement of the skate base 6 from the shoe sole 5*a*. An elastic element 65 is provided around each tube 631 for biasing the associated sleeve 64 to its initial position in which the inner flange 641 of the sleeve 64 is aligned with the conic holes 632 in the tube 631.

Figure 8:
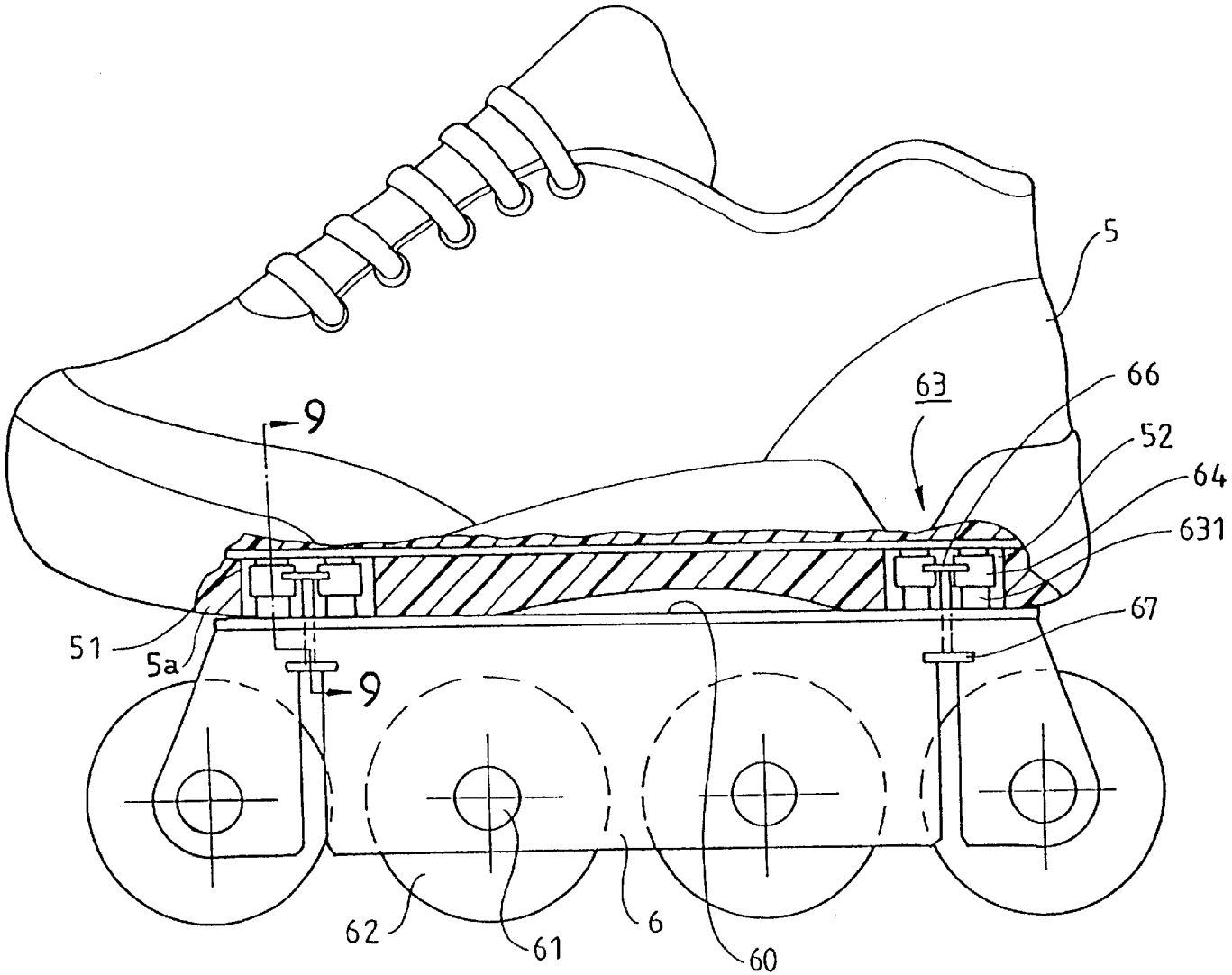
FIG. 8 is a side view, partly sectioned, of the roller skate in FIG. 6.

Referring to FIG. 8, when the user intends to skate, the rods 53 on the shoe 5 are engaged with the engaging members 63 on the skate base 6 to form a roller skate. When the user does not want to skate, the control plate 67 is actuated to move the sleeves 64, thereby disengaging the engaging members 63 from the rods 53. Thus, the skate base 6 can be easily detached from the shoe sole 5*a*, thereby reducing the weight and providing comfort wearing.

Figure 11:
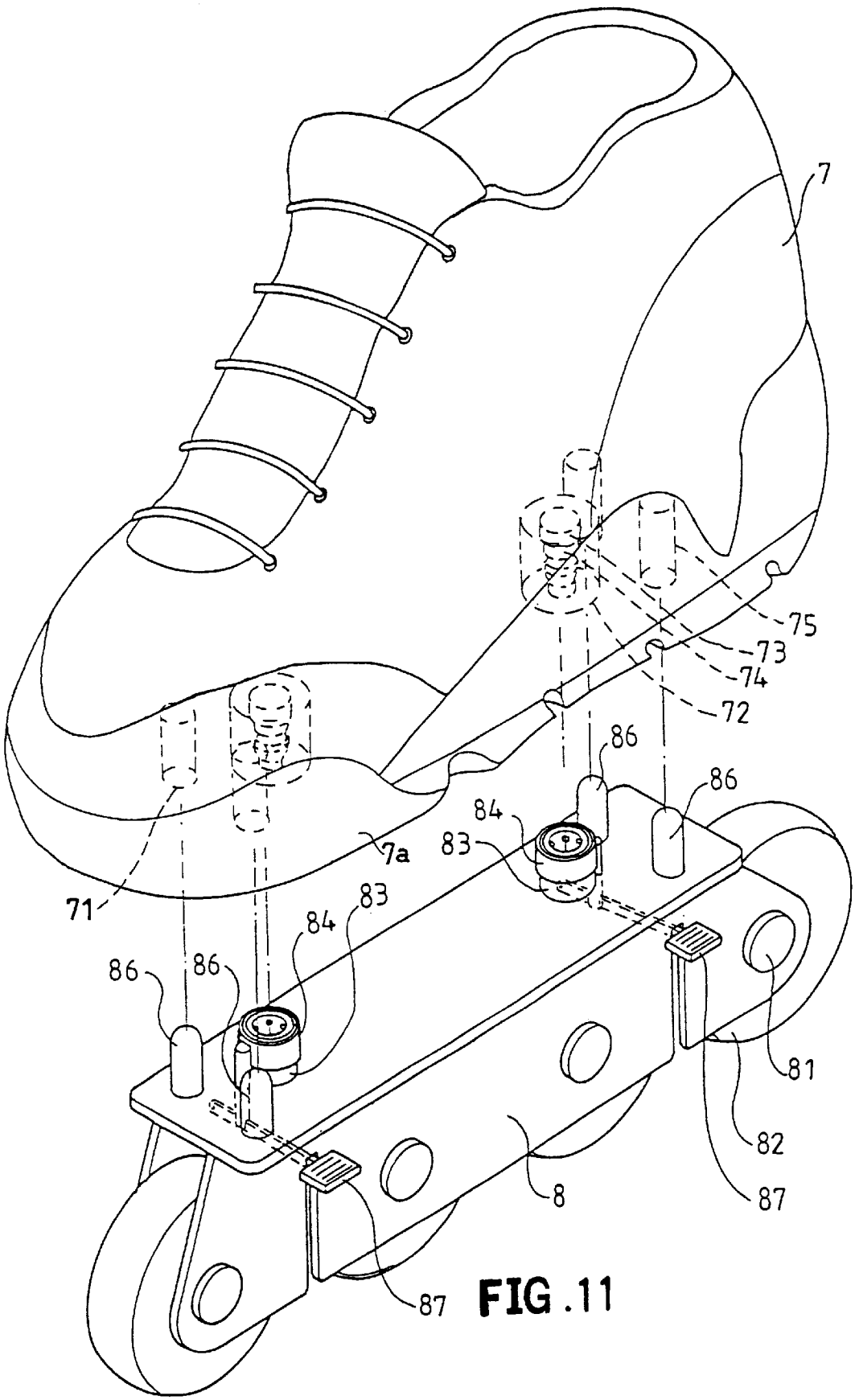
FIG. 11 is an exploded perspective view of a fourth embodiment of the roller skate in accordance with the present invention.

FIG. 11 illustrates a fourth embodiment of the roller skate in accordance with the present invention. The roller skate includes a shoe 7 and a skate base 8. The shoe 7 includes at least two engaging sections 71 and 72 in an underside of a sole 7*a* thereof The engaging sections 71 and 72 are preferably located corresponding to front and rear ends of an arch of a wearer's foot. In this embodiment, each of two engaging sections 71 and 72 has a rod 73 extended therefrom and two positioning holes 75. Each positioning hole 75 may be a hole in an insert embedded in the shoe sole 7*a* to avoid enlargement.

The skate base 8 includes a top side 80 for engaging with the shoe sole 7*a*. The skate base 8 further includes a plurality of axles 81 each for rotatably mounting a wheel 82. Engaging members 83 and engaging pegs 86 are provided on the top side 80 of the skate base 8. In this embodiment, the top side 80 includes an engaging member 83 and two engaging pegs 86 in each of front and rear ends thereof As disclosed in the third embodiment, the engaging member 83 in the fourth embodiment includes a tube for receiving an associated rod 73. The tube includes at least one radial conic hole that converges inward. Each radial conic hole includes a ball that may partially protrude into an interior of the tube without the risk of disengagement from the tube, thereby engaging with the annular groove 74 of the associated rod 73. A sleeve 84 is mounted around the tube and slidable relative to the tube along a longitudinal direction. The sleeve 84 includes an inner flange for biasing the balls inward go as to be engaged with the annular groove 74 of the associated rod 73 when required. By such arrangement, the sleeve 84 is moved downward by a control plate 87 such that the balls of the engaging member are disengaged from the annular groove 74 of the associated rod 73, thereby allowing disengagement of the skate base 8 from the shoe sole 7*a*.

When the user intends to skate, the rods 73 on the shoe 7 are engaged with the engaging members 83 on the skate base 8 and the engaging pegs 86 are engaged in the positioning holes 75 of the shoe 7 to form a roller skate. When the user does not want to skate, the control plate 87 is actuated to move the sleeve 84, thereby disengaging the engaging member 83 from the rod 73. Thus, the skate base 8 can be easily detached from the shoe sole 7*a*, thereby reducing the weight and providing comfort wearing.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A roller skate comprising:

a shoe having a sole, the sole having two engaging sections formed in an underside thereof, the engaging sections being located corresponding to front and rear ends of an arch of a wearer's foot, each said engaging section including at least one rod, each said rod having an annular groove in an outer periphery thereof; and a skate bane having a plurality of axles each for rotatably mounting a wheel thereon, the skate base including a corresponding number of engaging members formed on a top side thereof for releasably engaging with the engaging sections on the shoe sole, respectively, each said engaging member including a tube for engaging with an associated said rod, said tube including at least one radial hole for receiving a ball therein, the ball being movable to be partially protruded into an interior of the tube and being prevented from being disengaged from the tube, a sleeve being slidably mounted around the tube, the sleeve including an inner flange that is movable to a first position aligned with said at least one radial hole of the tube and a second position not aligned with said at least one radial hole of the tube.

2. The roller skate as claimed in claim 1, wherein the sleeves mounted around the tubes are connected by a common plate, further comprising a control plate to control vertical movement of the common plate, thereby moving the sleeves.

3. The roller skate as claimed in claim 1, further comprising an elastic element mounted around each said sleeve for returning the sleeve when a force acting on the sleeve is released.

4. The roller skate as claimed in claim 2, further comprising an elastic element mounted around each said sleeve for returning the sleeve when a force acting on the sleeve is released.

5. The roller skate as claimed in claim 1, wherein the underside of the sole includes at least one positioning hole, and wherein the top side of the skate base includes at least one engaging peg for engaging with said at least one positioning hole.

6. The roller skate as claimed in claim 5, wherein said at least one positioning hole is formed by a hole of an insert that is embedded in the underside of the sole.

* * * * *